US005294124A

United States Patent [19]

Florian

[11] Patent Number: 5,294,124

[45] Date of Patent: Mar. 15, 1994

[54] GOLFER'S PUTTING PRACTICE DEVICE

[76] Inventor: Raymond J. Florian, 1440 Elwell Rd., Belleville, Mich. 48111

[21] Appl. No.: 870,142

[22] Filed: Apr. 17, 1992

[51] Int. Cl.[5] ..... A63B 69/36

[52] U.S. Cl. ..... 273/186.1; 359/838; 359/850; 359/865; 359/870; 273/35 A; 40/219

[58] Field of Search ..... 273/35 A, 186.1, 187 R, 273/187 A; 359/838, 850, 865, 870; 40/219

[56] References Cited

U.S. PATENT DOCUMENTS

| | | | |
|---|---|---|---|
| 3,471,155 | 10/1969 | Donaldson | 273/192 |
| 3,934,874 | 1/1976 | Henderson | 273/35 A |
| 3,934,882 | 1/1976 | Whitaker | 273/35 A X |

FOREIGN PATENT DOCUMENTS

| | | | |
|---|---|---|---|
| 2130103 | 5/1984 | United Kingdom | 273/35 A |

*Primary Examiner*—George J. Marlo
*Attorney, Agent, or Firm*—Harness, Dickey & Pierce

[57] ABSTRACT

The present invention provides for a practice mirror for improving golf putting skill. The practice mirror is comprised of a generally planar reflective surface, upon which are a stance line, a target line perpendicularly intersecting the stance line, and a positioner for locating a golf ball. The positioner is located at the intersection of the stance and target lines, this intersection lying approximately at one quartile of the stance line. In operation, the golfer places the mirror on the ground, places a golf ball in the positioner and aligns his body and putter club by standing over the mirror and viewing his reflection. This allows the golfer to detect and correct body alignment errors that would otherwise go undetected, thereby improving his putting skill. In a slotted, or channel, embodiment the golfer can perform an actual putt by means of the channel. The distance between the edges of the channel are such that when a golf ball is putted away from the closed end of the channel at any angle other than substantially parallel to the edges of the channel, the golf ball ricochets against the edges of the channel before traveling out of the channel.

7 Claims, 4 Drawing Sheets

10'''
12'''
14'''
18'''
30'''
32'''
40'''
50'''
52a
52b
54'''
62
64
10''
50
54
30''

GOLFER'S PUTTING PRACTICE DEVICE

BACKGROUND OF THE INVENTION

This invention relates generally to practice mirrors, and more particularly to a mirror adapted for use in improving golf putting skill.

As most sports enthusiasts can appreciate, the difference between simply being able to participate in the sport versus being able to excel in the sport often depends upon the participant's ability to control his body movement so as to optimize skill and coordination. To some degree, a participant can improve his skill in a sport by being instructed as to proper body position. However, instruction alone is often of limited assistance. This is because the participant may actually think that he is positioning or moving his body in accordance with the instructions. However, if the participant were able to observe his actions from the point of view of another party, the participant could be able to realize he is not practicing proper body positioning after all. Therefore, it would be advantageous to provide a means by which the participant in a sport can observe his body position or motion while he is participating in the sport so as to allow the participant to make necessary corrections.

In the sport of golf, proper positioning of the head, shoulders, hands and club are critical to ensuring the accuracy of putting. Yet, all too often, the golfer is unable to advance his putting skills due to his inability to observe his own actions from a third party point of view. Therefore, it would be advantageous to provide a device which would enable a golfer to observe his stance, grip and swing while putting. It would be further advantageous if such a device were composed of a durable material, which would resist breakage from rough handling and, more importantly, from an accidental blow by the golf club when the golfer is practicing. It would be further advantageous if such a device were compact, light weight and easily transportable so that the golfer could practice putting wherever he finds it convenient and yet of sufficient size to provide the golfer ample view of his body positioning and movement.

SUMMARY OF THE INVENTION

It is therefore an object of the present invention to provide a practice mirror for improving golf putting skill. The mirror is comprised of a generally thin planar reflective surface, upon which are located a stance line and a target line perpendicularly intersecting the stance line. The mirror includes a positioning means for locating a golf ball relative to the stance and target lines, and also includes a plurality of swing alignment lines which allows for actual repetitive putting practice. In one form of the invention, the positioning means can take the form of a dimple in the mirror surface which dimple is located at the intersection of the stance and target lines. In another form of the invention, a channel or slot is provided rather than a dimple. In operation, the golfer places the mirror on the ground, places a golf ball in the positioning means, such as the dimple, and aligns his body and putter club by standing over the mirror and viewing his reflective image. This allows the golfer to detect and correct body alignment errors that would otherwise go undetected, thereby improving his putting skill. Also, when using the slotted, or channel, form of the invention, the golfer can observe the travel of the golf ball as it is putted, where a ricocheting action of the ball is indicative of a poorly putted ball.

BRIEF DESCRIPTION OF THE DRAWINGS

The present invention can be better understood by referencing the detailed description of the presently preferred embodiments in conjunction with the drawings in which:

FIG. 7A is a fragmentary plan view, to increased scale, of the practice mirror of FIGS. 5A and 5B illustrating the line of travel of a well putted golf ball, while

DETAILED DESCRIPTION OF THE PREFERRED EMBODIMENT

Figure 1B:
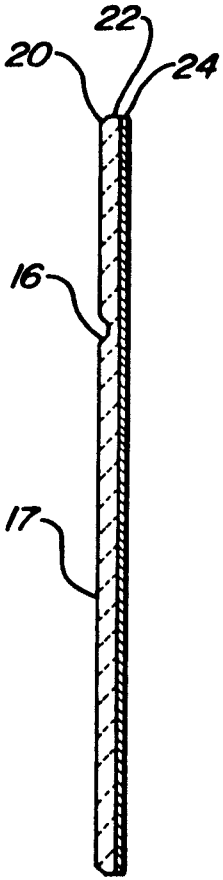
FIG. 1B is a sectional view of the practice mirror taken generally in the direction of arrows 1B—1B.
Figure 1A:
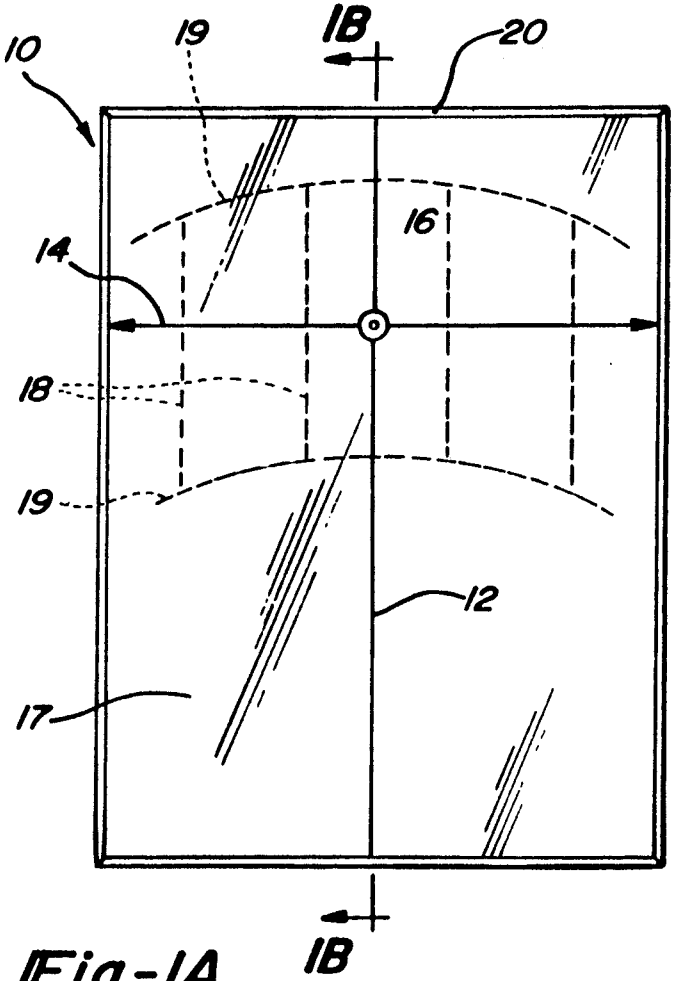
FIG. 1A is a plan view of the practice mirror.

As shown in detail in FIGS. 1A and 1B, one form of the invention includes a rectangular mirror 10 with a stance line 12 and a target line 14. The target line 14 perpendicularly intersects the stance line 12 at approximately the first quartile of the stance line 12. A dimple 16 is formed in the upper surface 17 of the mirror 10. The dimple is located at the intersection of the stance line 12 and target line 14 and is of a size and shape for receiving a golf ball. The dimple 16 is generally conical in shape, approximately five sixteenths of an inch in diameter and one sixteenth inch deep. The shape and size of the dimple 16 is selected to be minimal and just sufficient to allow the golf ball to be held in place without rolling out of position, yet it also allows the golf ball to be addressed by the golfer and putted away from the resting position with minimal interference. Additionally, it should be appreciated that other means could be provided for positioning the golf ball in the upper surface 17 such as a spot of felt or other relatively soft material.

Perpendicularly intersecting the target line are four swing lines 18, each swing line being located at approximately the mid-points of the first, second, third and fourth quartiles of the target line, respectively. The swing lines 18 are arranged so that the end points of the lines lie in a generally arced path 19. The arced path 19 defines a desired line of travel of the putter head as it addresses the golf ball. The mirror 10 is approximately nine inches wide, twelve inches long and one-quarter inch thick. It is believed that this sized mirror 10 provides a compact, efficient structure, while still providing an adequate viewing surface for the user. The edges 20 along the face of the mirror 10 are beveled. The beveled edges 20 not only provide for a more pleasant aesthetic appearance, but also insure that the mirror 10 maintains its pleasant aesthetic appearance by eliminating sharp edges that could otherwise be chipped.

Figure 2:
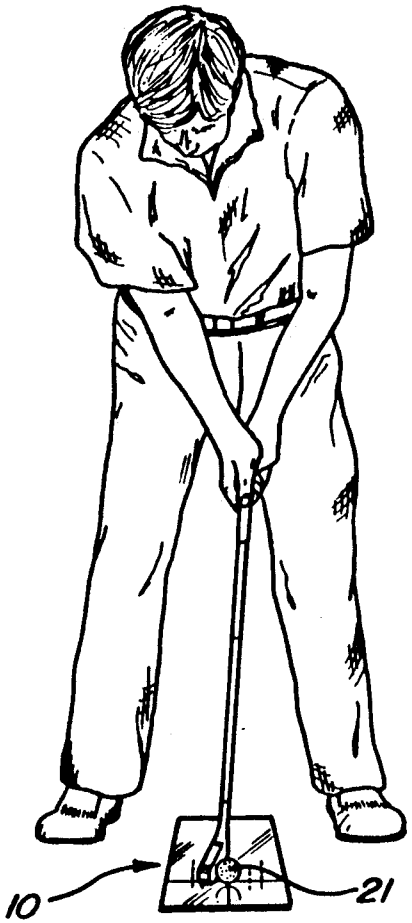
FIG. 2 is a perspective illustration of a golfer utilizing the practice mirror of FIGS. 1A and 1B.
Figure 3:
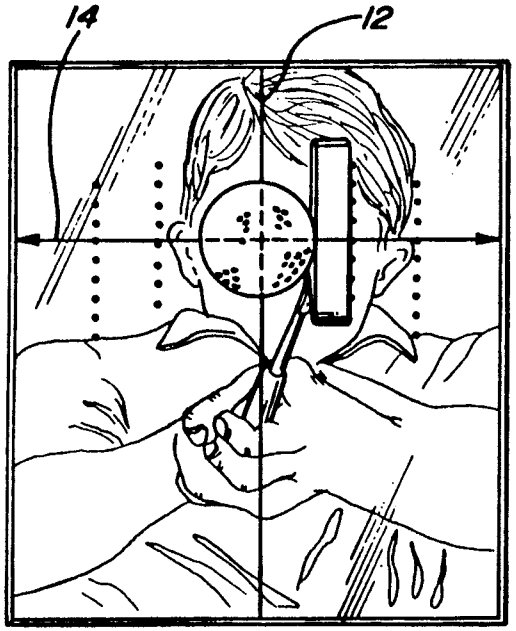
FIG. 3 is a pictorial illustration of the reflection that the golfer in FIG. 2 would see in the practice mirror.

The mirror 10, is comprised of a relatively tough durable material, and in one form of the invention has a base 22 made of an acrylic material with a reflective coating 24 applied to the backside. The acrylic base 22 is rough and relatively break-resistant and therefore well suited to this particular application where the golf club bead may accidentally strike the mirror 10. As illustrated in FIG. 2, in use the golfer places the mirror 10 on the ground, sets a golf ball 21 in the dimple 16, and practices putting. By standing over the mirror 10 and viewing his reflection, as illustrated in FIG. 3, the golfer can observe his body alignment and movement while putting. The stance line 12 helps the golfer align his head and hands, while the target line 14 aids the golfer in achieving proper alignment of his shoulders. As he swings, the golfer can observe whether the putter head remains perpendicular to the target line 14 and hence perpendicular to the desired direction of travel for the ball, whether his shoulders remain parallel to the target line and hence parallel to the desired direction of travel, whether his hands remain forward of the club face and essentially coincident with the ball at the point of contact, and whether his head remains in proper alignment by keeping his eyes parallel to the target line. Also, because the swing lines 18 have their end points arranged to define a desired arc 19, the golfer can further observe whether his backswing and follow-through occur in the proper path while still remaining perpendicular to the desired direction of ball travel.

Figure 4B:
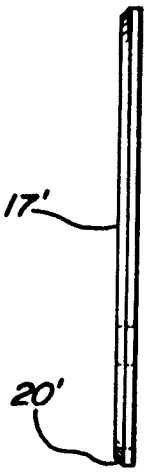
FIG. 4A is a plan view of a first modified embodiment of the practice mirror which includes a locating and guide channel and FIG. 4B is a side view of the first modified embodiment of the practice mirror.
Figure 4A:
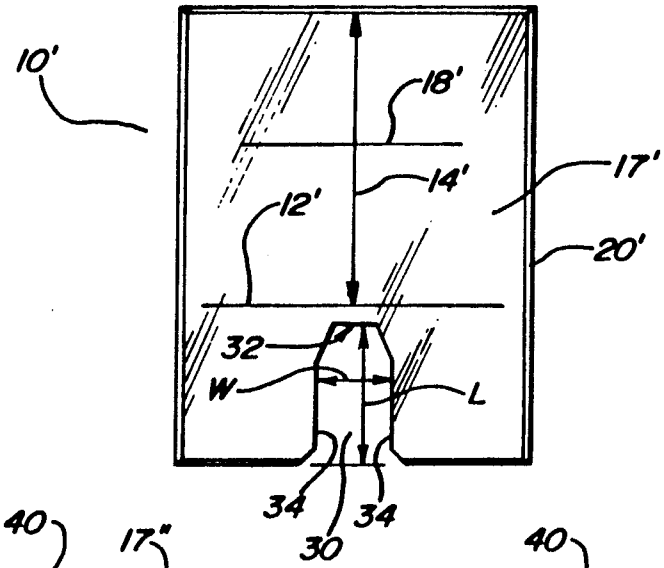

As one can appreciate from the foregoing description of the embodiment of FIGS. 1A and 1B, other embodiments having modified features are possible. It should be appreciated that the discussions of modified embodiments include like components to the first embodiment, and, as such, these like elements will be denoted using the same reference numerals with the addition of one or more primes and hence the detailed description thereof may be omitted for purposes of simplicity. As illustrated in FIGS. 4A and 4B, a first modified embodiment takes the form of a mirror 10' of somewhat smaller proportions and having a different means for positioning the golf ball. More particularly, in this embodiment, the mirror 10' is approximately 5½ inches wide and 8½ inches long, ¼ inches thick, with beveled edges 20'. The stance line 12' intersects the target line 14', and a single swing line 18' intersects the target line 14'. In this first embodiment, a channel 30 is located at the front of the mirror 10 for receiving the golf ball. The closed end 32 of the channel 30 is located nearest the intersection of the stance line 12' and target line 14', and is generally hexagonal in shape. The width W of the channel 30 is approximately 1¾ inches while the length L is approximately 4¼ inches. The channel 30 is shaped in this manner so that the golf ball can be placed at rest at the closed end 32 of the channel 30. More particularly, the width of the channel 30 is such that there is a slight clearance between the golf ball and the edges 34 of the channel 30. In operation, if the head of the putter addresses the golf ball in a manner other than directly perpendicular to the desired line of travel (i.e., target line 14'), the golf ball can ricochet back and forth against the sides of the channel 34 as it travels out of the channel 30. Thus, in this embodiment, not only is the golfer able to observe his reflection to detect improper putter head alignment, but is also provided with the ricocheting reaction of the golf ball (as will be discussed in more detail later) in the event that proper putter head alignment is not maintained through his swing. It can also be appreciated that the clearance between the golf ball and the edges of the channel 30 also allow the mirror 10' to be slid into position around a golf ball already resting on the ground, should the user desire to utilize the mirror without disturbing the resting position of the golf ball.

Figure 5B:
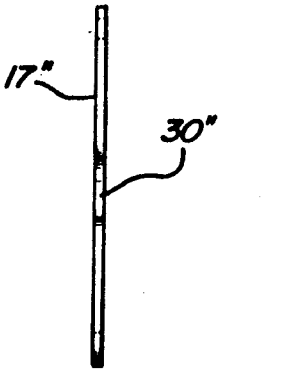
FIG. 5B is a front view of the second modified embodiment of the practice mirror.
Figure 5A:
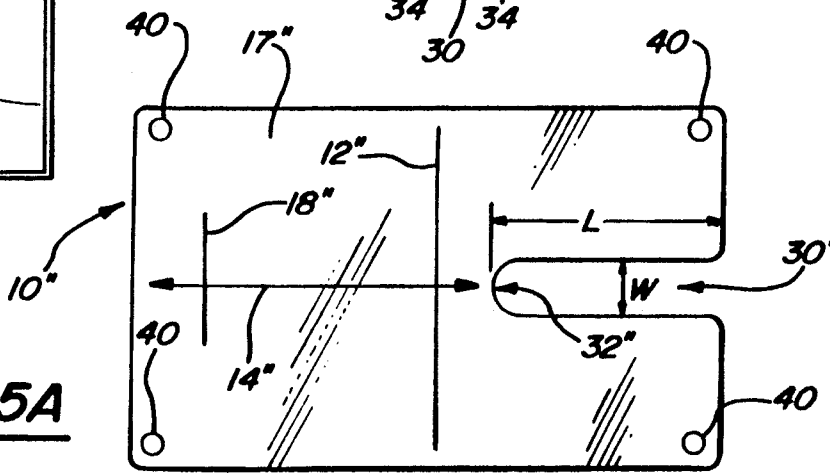
FIG. 5A is a plan view of a second modified embodiment of the practice mirror which includes a modified locating and guide channel.

In another modified embodiment, as illustrated in FIGS. 5A and 5B, the mirror 10'' is approximately 9 inches wide and 12 inches long. However, in this embodiment, the channel 30'' has a rounded end 32'' nearest the intersection of the stance line 12'' and the target line 14''. Also, the mirror 10'' is much thinner in this embodiment, being approximately ⅛ inch thick. As a result, the width W'' of the channel 30'' is slightly narrower than that of the channel 30 in the embodiment of FIGS. 4A and 4B, being approximately 1⅜ inches wide. Also, because the mirror is longer, the channel 30 is longer and, in the embodiment as shown, is approximately 6 inches long. As further included in this embodiment, positioning holes 40 are provided at each corner of the mirror 10'', through which golf tees or other objects can be inserted to stake the mirror 10'' securely to the ground while it is being used.

Figure 6A:
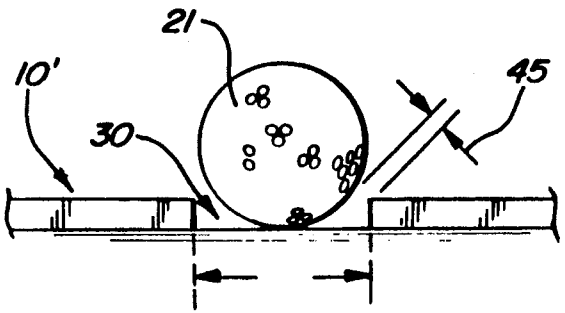
FIG. 6A is an end, fragmentary view, to increased scale, of the practice mirror of FIGS. 4A and 4B illustrating the geometric clearance relationship between the golf ball and the channel.
Figure 6B:
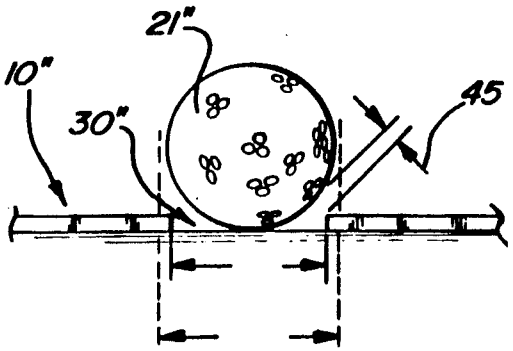
FIG. 6B is an end fragmentary view, to increased scale, of the embodiment of FIGS. 5A and 5B illustrating the geometric relationship between the golf ball and the channel.

A narrower channel 30'' can be used in this embodiment due to the fact that the mirror 10'' is thinner. With the mirror 10'' being thinner, the plane of the upper surface 17'' is at a point on the golf ball where the cross-sectional radius of the golf ball is smaller than the cross-sectional radius of the golf ball as it would intersect the plane of the upper surface 17' of the mirror 10' of FIG. 4A. This relationship is illustrated in FIGS. 6A and 6B. In FIG. 6A, the geometric tolerancing relationship of the practice mirror 10' of FIGS. 4A and 4B is detailed. The practice mirror 10', being approximately ¼ inch thick, has a channel 30 with a width W of approximately 1¾ inches, as was disclosed earlier. When the golf ball 21 is resting within the channel 30, a tolerance 45 of approximately 3/16 of an inch lies between the contacting surface of the golf ball 21 and each side of the channel 30. When the practice mirror is thinner, as is the case of the practice mirror 10'', illustrated in FIGS. 5A, 5B and 6B, the channel 30'' need have a width W'' of only 1⅜ inches to provide the same approximate 3/16 inch tolerance 45'' between the golf ball 21'' and each side of the channel 30''.

Figure 7A:
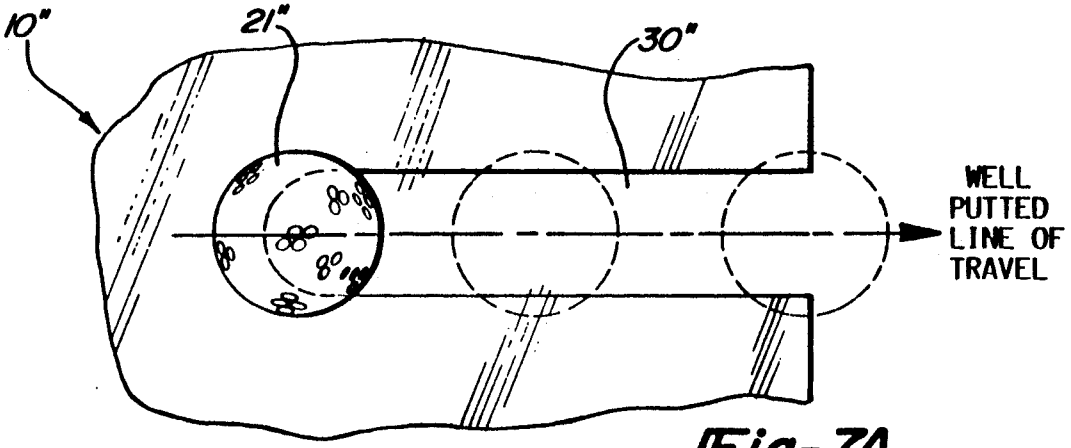
Figure 7B:
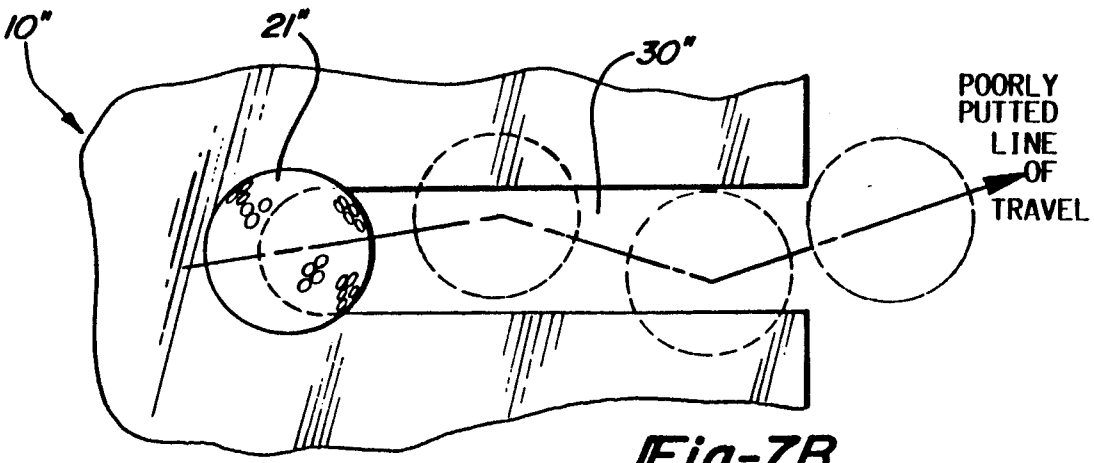
FIG. 7B is similar to FIG. 7A but illustrates the line of travel of a poorly putted golf ball.

The tolerance 45, 45'' is provided between the golf ball 21, 21'' and channel 30, 30'' so that the golfer is provided with feedback as to the line of travel of the golf ball. As illustrated in FIGS. 7A and 7B, which demonstrate the travel of golf ball 21'' within the channel 30'' of the mirror of FIGS. 5A and 5B, a well putted ball will travel straight out of the channel 30'' (see FIG. 7A). However, if the golf ball 21'' is putted slightly out of line, it will ricochet within the channel 30'' (see FIG. 7B).

Figures 8A, 8B, 9A, 9B:
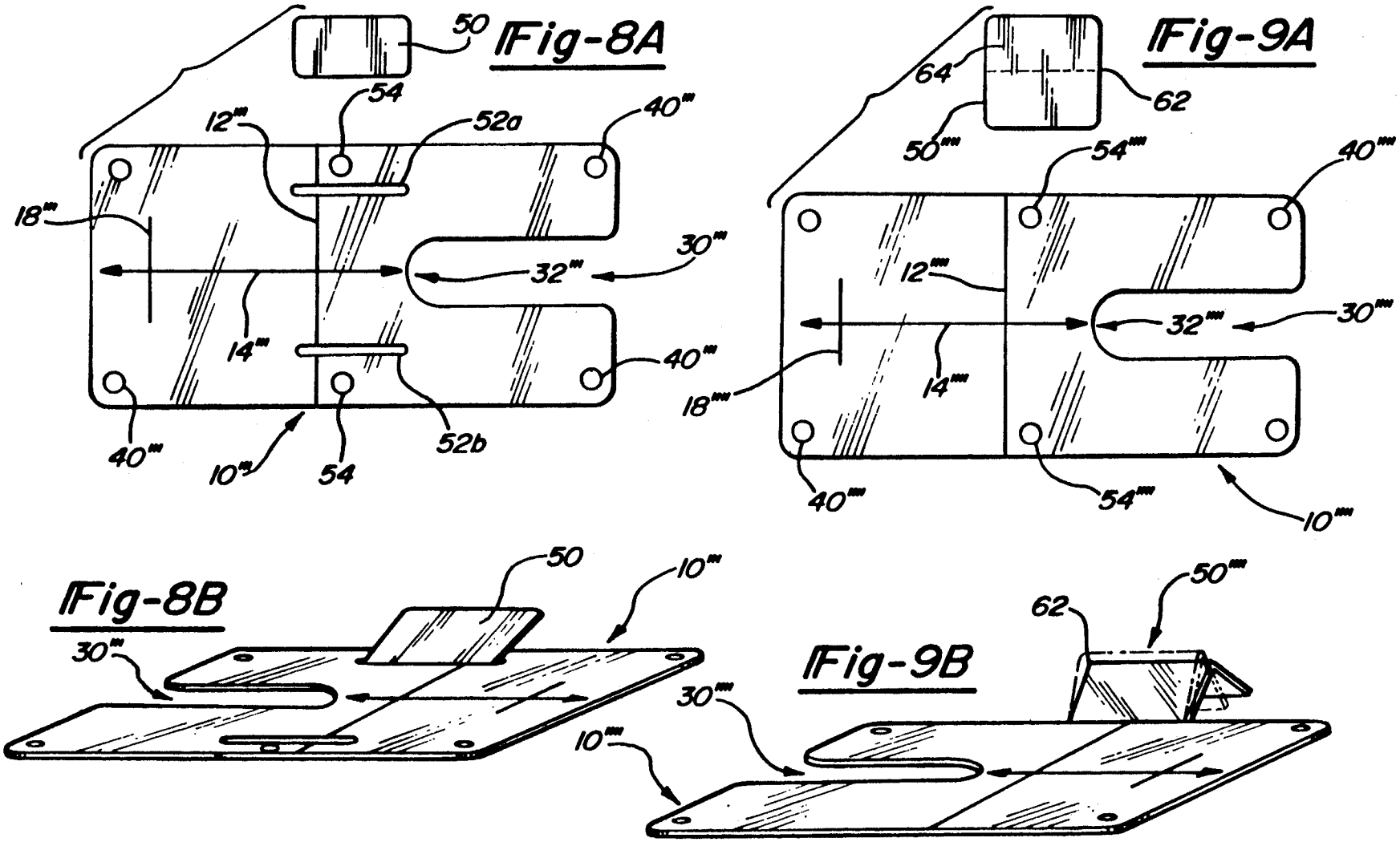
FIG. 8A is the plan view of a third modified embodiment of the practice mirror with a supplemental angle viewing mirror.
FIG. 8B is a perspective view of the third modified embodiment of the practice mirror illustrating the alignment of the practice mirror and supplemental angle viewing mirror when assembled.
FIG. 9A is a plan view of a fourth modified embodiment of the practice mirror with a modified supplemental angle viewing mirror.
FIG. 9B is a perspective view of the fourth modified embodiment showing the modified supplemental angle viewing mirror in use with the practice mirror, with articulation of the modified supplemental angle viewing mirror in different positions shown in phantom.

A third modified embodiment, as illustrated in FIGS. 8A and 8B, provides for a mirror 10''', which is essentially the same as mirror 10'' of FIGS. 5A, 5B with the addition of a supplemental angular viewing mirror 50. This supplemental mirror 50 is approximately 3½ inch wide, 3 inches long and ⅛ inch thick, and is adapted to be received by slots 52A or 52B (depending upon whether the golfer is left-handed or right-handed) to provide the golfer with a side view of the putter head and golf ball. More particularly, the slots 52A, B are approximately 3¾ inches long and ¼ inch wide. Thus, when the supplemental mirror 50 is inserted in the slots 52A, B, it can be tilted at an approximate 45° angle. In the event that the golfer requires a tilt angle greater than approximately 45°, supplemental holes 54 are provided adjacent each slot 52A, B into which a golf tee or other suitable support object can be placed to provide undersupport for the supplemental mirror 50 to permit selection of the desired angle of tilt. By using the supplement mirror 50 in conjunction with the practice mirror 10''', the golfer can view his vertical body alignment and his vertical putter head-to-golf ball alignment in the practice mirror 10''', while viewing the horizontal putter head-to-golf ball alignment in the supplemental mirror 50. The supplemental mirror 50 can be made of a durable material similar to that of mirror 10'''.

A fourth modified embodiment is illustrated in FIGS. 9A and 9B. The mirror 10'''' is substantially the same as mirror 10''' of FIGS. 8A, 8B but a modified supplemental angular viewing mirror 50'''' is provided which has a living hinge 62. The living hinge 62 allows the supplemental angular viewing mirror 50'''' to be flexed so as to provide selected multiple viewing angles, as illustrated in FIG. 9B. In this embodiment, the supplemental mirror 50'''' is composed of a flexible material made from a flexible polymer such as polyethylene terephthalate glycol, commonly referred to by its acronym PET-G, so as to allow the supplemental mirror 50'''' to be flexed as illustrated. As can be appreciated from the illustration, the viewing angle of the supplemental angular mirror 50'''' can be adjusted to suit the golfer's needs. The supplemental mirror 50'''' can be placed either on the practice mirror 10'''' or can be placed on the ground adjacent to the mirror.

It can also be appreciated that it may be preferable to provide for a non-glare tint, such as bronze, to be applied to the practice mirror 10–10''''. By providing for a tint, the golfer can better view his body alignment with respect to the stance 12 and target 14 lines as well as his golf putter head with respect to the ball 21 and the swing lines 18 without being blinded by upwardly reflected glare. Since the supplemental mirror 50, 50'''' is at an angle with respect to the golfer, the need for a non-glare tint on the supplemental mirror is not so critical.

The foregoing description of the preferred embodiment was provided for the purposes of illustration and description. It should be appreciated by one of ordinary skill in the art that various modifications could be exercised without departing from the spirit or scope of this invention.

What is claimed is:

1. A practice mirror for improving golf putting skill, said mirror comprising:

a flat planar mirror member having a generally planar upper reflective surface and a lower planar support surface;

said upper and lower surfaces being generally parallel and providing a thin gauge structure, said flat planar member defining a substantially open, unrestricted putting surface for addressing and hitting the golf ball in practice putting;

a target line image on said upper surface, said target line substantially bisecting said upper surface; and a positioning means for receiving a golf ball to be practice putted also bisected by said target line image;

said positioning means being a channel extending from approximately the mid-point of one edge of said planar member to a closed end generally toward the center of said planar member, in alignment with said target line image, said channel having parallel edges spaced to define a width dimension wide enough to accept a golf ball while providing a preselected clearance between said golf ball and said edges of said channel such that when said golf ball is putted away from said closed end of said channel at any angle other than substantially parallel to said edges of said channel said golf ball ricochets against said edges of said channel before traveling out of said channel;

said planar member adapted to be placed on the ground and supported on said support surface whereby said upper reflective surface is generally parallel to the ground, said upper reflective surface with said planar member on the ground adapted to provide a reflected image of the golfer and putter club whereby the golfer by viewing his reflection is able to detect and correct alignment errors that might otherwise go undetected, thereby improving his putting skill.

2. The practice mirror claim 1 with said planar reflective surface comprising a resilient reflective material such as acrylic.

3. The practice mirror of claim 1 with said reflective surface being between around five and nine inches wide and between around eight and twelve inches long, whereby the practice mirror is sufficiently compact so as to be easily transportable by the golfer and whereby during use in practice putting said reflective surface is sufficiently large enough to provide the golfer with a view of his head, shoulders, arms and torso.

4. The practice mirror of claim 1 further including a separate mirror member having a second reflective surface, said separate mirror member being adapted to be movably secured to said flat planar member.

5. The practice mirror of claim 4 wherein said separate mirror member includes a living hinge for providing relative adjustment of said second reflective surface.

6. The practice mirror of claim 1 with a stance line image on said upper reflective surface perpendicularly intersecting said target line image.

7. The practice mirror of claim 6 wherein said channel extends from said intersection of said stance and target line images to said one edge of said planar member.

* * * * *